United States Patent [19]

Honickman

[11] 4,324,076

[45] * Apr. 13, 1982

[54] WALL UNITS

[76] Inventor: Reuben Honickman, Ste. 4B, 66 Collier St., Toronto, Ontario, Canada, M4W 1L9

[ * ] Notice: The portion of the term of this patent subsequent to Feb. 5, 1997, has been disclaimed.

[21] Appl. No.: 46,145

[22] Filed: Jun. 6, 1979

Related U.S. Application Data

[63] Continuation-in-part of Ser. No. 903,322, May 5, 1978, Pat. No. 4,186,666.

[51] Int. Cl.[3] ..... A47B 41/04; E04F 19/00

[52] U.S. Cl. ..... 52/27; 52/36; 108/29; 108/107; 108/111

[58] Field of Search ..... 108/107, 111, 29, 114, 108/108; 52/36, 802, 239; 211/190, 191

[56] References Cited

U.S. PATENT DOCUMENTS

| | | | |
|---|---|---|---|
| 1,163,914 | 12/1915 | Hargrave et al. | 52/802 |
| 1,613,447 | 1/1927 | Ellberg | 108/29 X |
| 3,478,891 | 11/1969 | Kaeslin | 108/29 X |
| 3,489,290 | 1/1970 | Larson | 211/190 |
| 3,538,842 | 11/1970 | Labbato | 108/29 |
| 4,043,086 | 8/1977 | Kaulfuss | 52/36 X |
| 4,186,666 | 2/1980 | Honickman | 108/29 |

*Primary Examiner*—Ramon S. Britts
*Assistant Examiner*—Peter A. Aschenbrenner
*Attorney, Agent, or Firm*—Rogers, Bereskin & Parr

[57] ABSTRACT

A closet structure is disclosed and is installed in a building having an alcove defined by first and second side walls and a back wall of said building. The closet is defined by wall units disposed on one of each of the side walls of the alcove with the back wall remaining exposed between the wall units. Each unit is in the form of a relatively rigid self-supporting panel formed with an array of openings for receiving article supporting elements engaged in said opening. Each panel is coupled to the relevant one of the side walls with the outer surface of the panels generally vertical and the inner surface spaced from the wall.

2 Claims, 14 Drawing Figures

WALL UNITS

This application is a continuation-in-part of U.S. Pat. application Ser. No. 903,322 filed May 5, 1978 now U.S. Pat. No. 4,186,666.

The invention relates to a wall unit for use in the storage and/or display of articles, for example in a store, and to structures incorporating such a unit.

The invention has been devised primarily, but not exclusively, in connection with the display of merchandise in stores. Conventional storage and display racks are often not well suited to merchandising applications in that they usually offer only a limited range of merchandise display configurations. For example, in a fixed shelf display rack, while merchandise can be appropriately arranged and rearranged on each shelf, the location of the shelves themselves often cannot be readily changed. In other cases, a complete reconstruction of a display is necessary to change the display configuration. Shelving structures have previously been proposed comprising vertical standards adapted to be secured to a wall surface, and shelf brackets which can be removably fitted to the standards at various positions according to desired shelf arrangements. A disadvantage of this type of structure is that it is really suitable only for supporting shelving and does not lend itself to other display arrangements. Also, in assembling the structure, the standards must be individually fitted to a wall surface and must be carefully aligned to ensure that these shelves are disposed horizontally.

An object of the present invention is to provide improvements in structures for use in the storage and/or display of articles which allows a more versatile arrangement of the articles than has previously been possible.

According to one aspect of the invention there is provided a wall unit comprising a relatively rigid, self-supporting panel which includes a front wall having an inner surface and a generally flat outer surface, and which is adapted to be supported in use with said outer surface generally vertical. That surface is formed with an array of openings covering substantially the whole of the surface, the openings being arranged in a plurality of vertical rows spaced equally across the surface with the openings in each row equally spaced from one another longitudinally of that row and in horizontal alignment with corresponding openings in adjacent rows. The openings extend through the front wall of the panel to the inner surface thereof and are adapted to cooperate with article supporting elements engageable in said openings for supporting articles from the unit. The invention also provides a display and/or storage structure incorporating one or more of said wall units.

In order that the invention may be more clearly understood, reference will now be made to the accompanying drawings which illustrate a number of embodiments of the invention by way of example, and in which.

Figure 1:
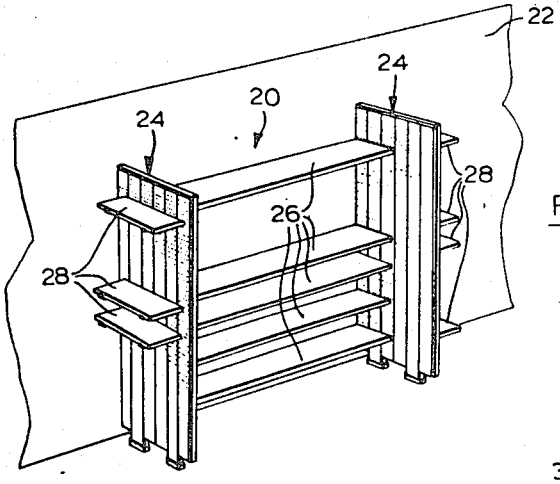
FIG. 1 is a perspective view of a display structure for a store which includes two of the wall units provided by the invention.

Referring first to FIG. 1, a display structure for use in a store is generally indicated at 20 and is shown positioned against an internal wall 22 in the store building. Structure 20 includes two indentical wall units, each denoted 24, which project outwardly from wall 22 at right angles thereto, and which are spaced from one another along the wall. In this embodiment, the wall units are used to support both shelves which extend between the two units, and which are denoted 26, and shelves 28 at the outer sides of the units.

Figure 2:
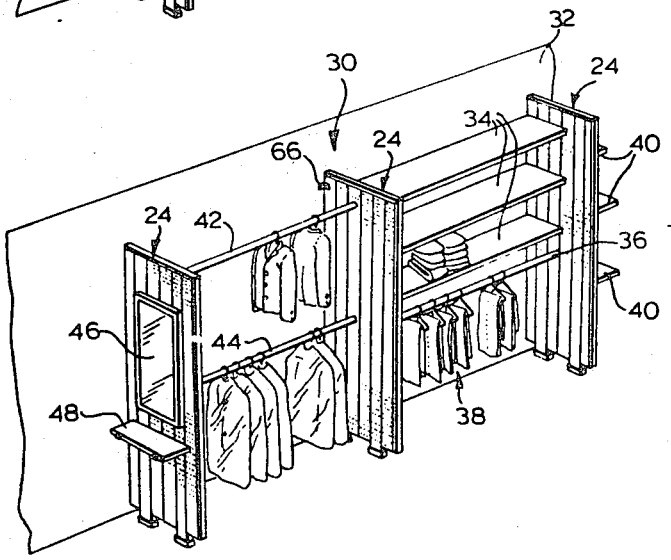
FIG. 2 is a view similar to FIG. 1 showing a structure which includes three such units.

FIG. 2 shows an alternative form of display structure according to the invention which includes three of the wall unit 24 shown in FIG. 1 disposed in equally spaced parallel positions at right angles to a wall 32 of the store building. In this case, the centre wall unit and the unit at the right hand end of structure 20 together support shelves 34 extending between the two units in similar fashion to the embodiment of FIG. 1. The two units also support a hanger rod 36 from which garments 38 are suspended. Further shelves 40 are disposed at the outer side of the right hand end unit 24. Two further hanger rods 42 and 44 extend between the centre wall unit and the left hand end wall unit, and the latter unit also carries a mirror 46 and a small shelf 48 at its outer side. Thus, it will be appreciated that the structure 30 shown in FIG. 2 can be used both for displaying shelf goods and hanging goods in the stoe, while also providing a mirror for assisting purchasers.

Figure 4:
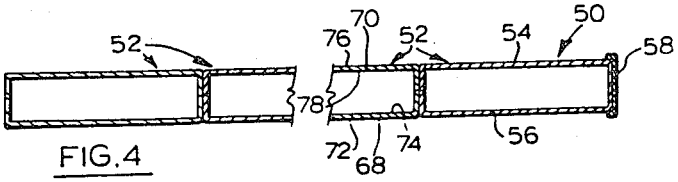
FIG. 4 is a horizontal sectional view on line IV—IV of FIG. 3.
Figure 3:
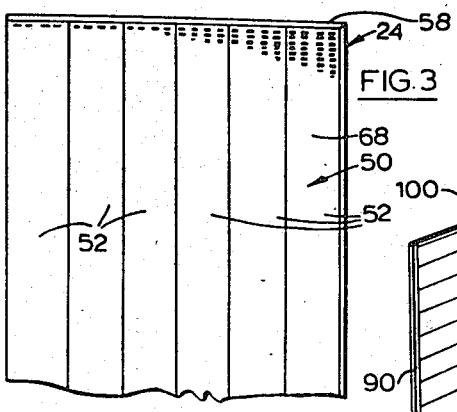
FIG. 3 is a front view of one of the wall units shown in FIGS. 1 and 2.

FIG. 3 is a front view of one of the wall units 24 shown in the previous views, and FIG. 4 is a horizontal sectional view through the unit of FIG. 3. Unit 24 includes a relatively rigid, self-supporting panel 50 made up of a series of vertical members 52 secured together side by side. Referring to FIG. 4, it will be seen that each of the members 52 is in fact of box section and is made up of two channel-shaped elements secured together with their channels facing one another. The two channel-shaped elements which make up one of the members 52 are denoted 54 and 56 in FIG. 4 and are welded together in the positions shown. The other members 52 are essentially the same and the members are welded together side edge to side edge in the configuration indicated in FIG. 4. In assembling the unit, the members 52 are first assembled from channel section elements such as those indicated at 54 and 56 and the assembled members are then welded together side edge to side edge as shown. The channel section elements comprise standard lengths of steel channel. A capping strip 58 is applied to the exposed side and top edge of the wall unit 24 as can be seen in FIG. 3 to provide the unit with a finished appearance. The other side edge is left plain in this case since that edge is to be fitted against a wall. However, it too could obviously be provided with a capping strip if necessary. The capping strip is also in the form of steel channel and is welded in place.

It will be seen from FIG. 3 that, in the particular embodiment illustrated, each wall unit 24 is made up of six of the members 52 and that the two members adjacent the two outer side members are slightly longer than the remaining members and project below the bottom edges of those members to form spigots, denoted 52*a* by which the unit is secured in place. Also, two sockets 60 dimensioned to receive the spigots 52*a* are secured by screws 62 to the floor 64 on which the wall is to be mounted in positions to receive the spigots. Thus, in mounting the wall unit, the unit is manually positioned with the spigots 52*a* in engagement with the sockets 60 and is manipulated to allow the spigots to drop into the sockets. In some instances, this mounting arrangement may be sufficient by itself. However, where the wall unit is liable to be subjected to lateral forces, it is desirable to also provide lateral restraining means. For example, in the embodiment shown in FIGS. 1 and 2, an angle bracket is screwed to each wall unit 24 adjacent its upper end and to the wall of the building. The bracket associated with the centre wall unit 24 in FIG. 2 is indicated at 66 and similar such brackets are provided for the other two wall units in that view and for the units in FIG. 1, although these brackets are not visible in the drawings.

Figure 5:
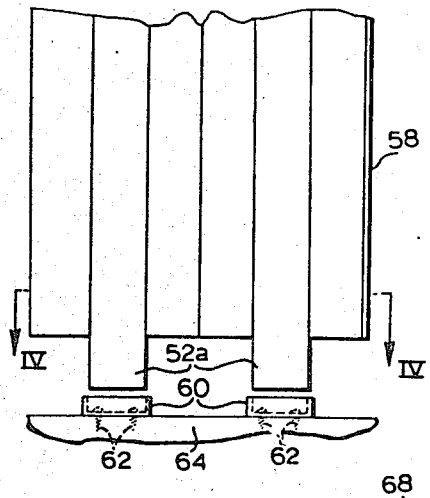
FIG. 5 is a detail view of part of FIG. 4.
Figure 5:
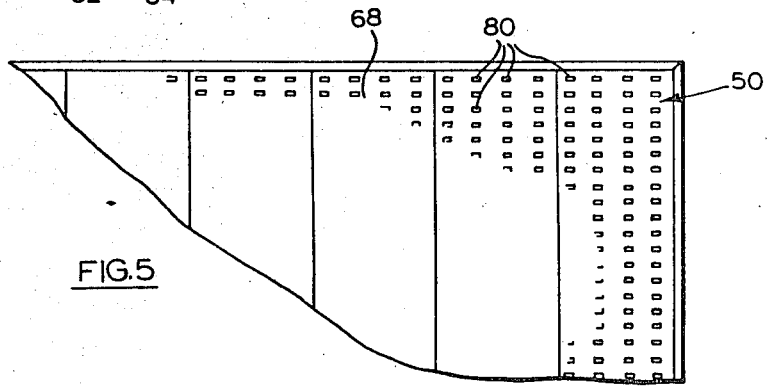

It will be appreciated from FIG. 4 in particular that panel 50 has front and rear walls formed by the bases of the channel section elements from which the panel is made. In this particular embodiment, the panel is symmetrical about a median plane and has identical front and rear walls. However, for convenience, the front wall of panel 50 will be considered as being the wall which is visible in FIGS. 3 and 5. The front wall of panel 50 is generally denoted 68 and the rear wall is denoted 70 (FIG. 4). Referring primarily to FIG. 4, front wall 68 has an outer surface 72 and an inner surface 74 and rear wall 70 has an outer surface 76 and inner surface 78. As best seen in FIGS. 3 and 5, the front wall 68 of panel 50 is formed with an array of openings, generally denoted 80 which are arranged in a plurality of vertical rows spaced equally across the outer surface of front wall 68 with the openings in each row equally spaced from one another longitudinally of that row. It will be seen from FIGS. 4 and 5 that each of the openings 80 is of rectangular shape and extends through the front wall 68 of panel 50 from its outer surface 72 to its inner surface 74. This allows article supporting elements (to be described) to be engaged in the openings for supporting an article from the wall unit. The rear wall 70 of panel 50 is formed with a similar array of openings, although these openings have not been specifically illustrated in the drawings since they are essentially the same as the openings in wall 68. The openings in the front and rear walls of panel 50 are in fact formed by a punching operation during manufacture of the channel section elements which make up the members 52 of panel 50.

It will be seen from FIG. 5 that the openings 80 are disposed so that the major axis of each opening lies in the transverse direction of panel 50. Thus, in manufacture of the channel section elements from which members 52 are made, the openings 80 are formed with their major axes extending transversely of the elements.

Figure 6:
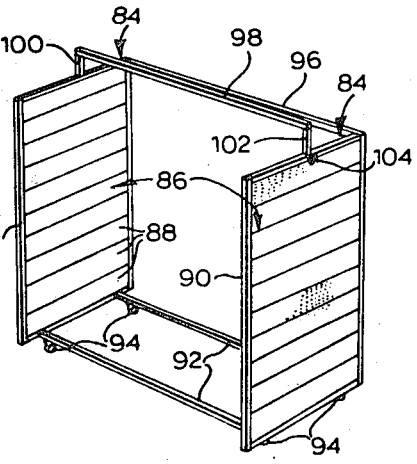
FIG. 6 shows an alternative form of display structure incorporating two wall units.

FIG. 6 shows a mobile form of display structure according to the invention. In that view, the structure is generally denoted 82 and includes two wall units 84. The units are essentially very similar to the units 24 described in connection with the previous figures in that each unit includes a relatively rigid, self-supporting panel (denoted 86) formed on both sides with an array of openings arranged in a plurality of horizontally and vertically aligned rows as described in connection with FIG. 5. However, the panels 86 are somewhat different in that each panel is made up of a plurality of horizontal members 88 which extend transversely of the panel, in contrast to the vertical members 52 of panel 50. Each member 88 comprises two channel-shaped elements which are essentially the same as the elements which make up panel 50 except that the openings in the elements of the FIG. 6 embodiment are disposed with their major dimensions extending longitudinally of the elements. As a result, in the assembled panel, the openings still appear as in the previous embodiment. Also in the FIG. 6 embodiment, each panel 86 is surrounded by a steel frame 90 made of box section members welded to the panel 86. The two frames 90 are joined by longitudinal box section members 92 welded to the two lower members in each frame 90. Castor wheels 94 are provided on the members 92. Also, a longitudinal member 96 extends between the top rear corners of the two frames 90 to form a relatively rigid unitary structure. A cross member 98 extends between the wall units 84 in an overhead position and is mounted at its ends on the upper ends of two vertical members 100 and 102 received in vertically slideable fashion in openings in the top members of the two frames 90. Set screws, one of which is visible at 104, are provided in each of those members for engagement with the respective vertical members 100 and 102 and can be used to secure those members in appropriate vertical positions. Thus, it will be appreciated that the position of the cross member 98 can be varied by releasing the set screws and sliding the vertical members 100 and 102 up or down as appropriate and retightening the set screws to secure the cross member in an adjusted position. Member 98 can be used for carrying overhead signs, displays, lights or the like according to the particular situation in which the display structure is used.

It will be appreciated that structure 82 will in practice be fitted with shelves, hanger rods, and other article supporting elements in similar fashion to the structures described in connection with the preceding figures, although, for clarity of illustration, those elements are not shown in FIG. 6.

Figure 7:
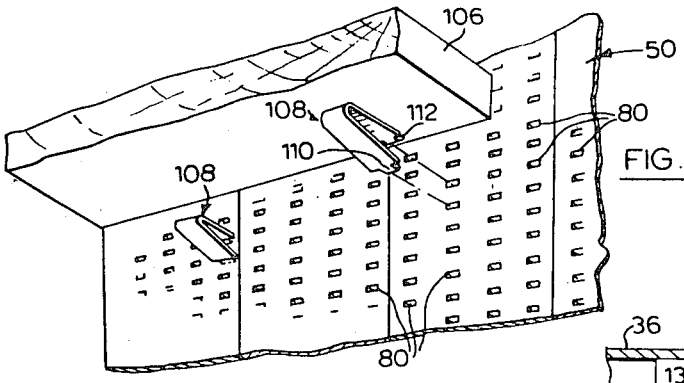
FIGS. 7 and 8 are detail views showing two alternative forms of article supporting elements which may be used with the structures shown in the previous views.
Figure 8:
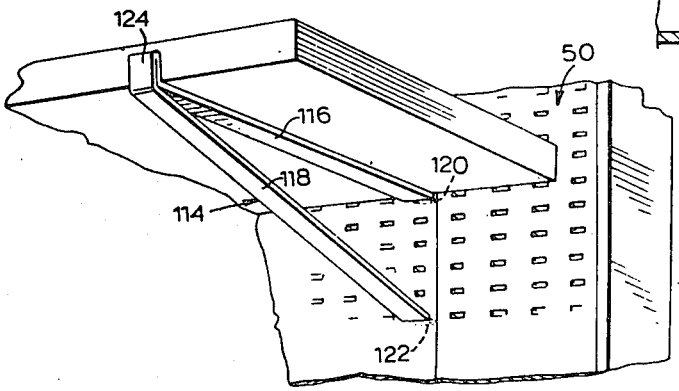

Reference will now be made to FIGS. 7 and 8 in describing two examples of shelf supports which may be used in association with the display structures described previously.

In FIG. 7, part of a shelf is indicated at 106 in association with part of the panel 50 of one of the wall units 24. The shelf is supported by two metal elements 108, one of which is shown engaged in panel 50, while the other is shown in an exploded position. It will be seen that each element is generally V-shaped in side view and includes tabs 110 and 112 at the outer ends of its limbs. The lower tab 110 is generally straight, while the upper tab 112 curves upwardly towards its outer end. Accordingly, this tab can be hooked through one of the openings 80 in panel 50 and engaged behind the inner surface of the front wall of the panel so that the element is restrained against outward movement away from the panel. The elements are fitted to the panel by first engaging the upper tab 112 as mentioned above, and then simply slotting the lower tab 110 into the opening 80 directly below the opening which receives tab 112. The element is shaped so that the limb of element 108 which is uppermost at this time is generally horizontal and forms, in effect, a ledge on which the shelf 106 rests. The elements 108 are used for supporting the ends of the shelf, for example as in the case of the shelves 26 and 34 in the embodiments of FIGS. 1 and 2 respectively.

FIG. 8 shows an alternative form of shelf support generally denoted 114. Support 114 is in principle very similar to one of the shelf support elements 108 in that it is generally V-shaped and defines an upper horizontal limb on which the shelf rests. Thus, element 114 has upper and lower limbs 116 and 118 respectively having tabs 120 and 122 respectively at their outer ends. The lower tab 122 is straight while the upper tab 120 is curved upwardly for providing a hook-type engagement with panel 50. At their inner ends, the two limbs 116 and 118 are joined by an upwardly turned tab 124 which in effect forms a stop restraining outward movement of the shelf away from panel 50. It will be appreciated that this form of shelf support is designed primarily for use in a situation in which the shelf extends transversely of panel 50, for example as in the case of the shelf 28 shown in FIG. 1.

Figure 9:
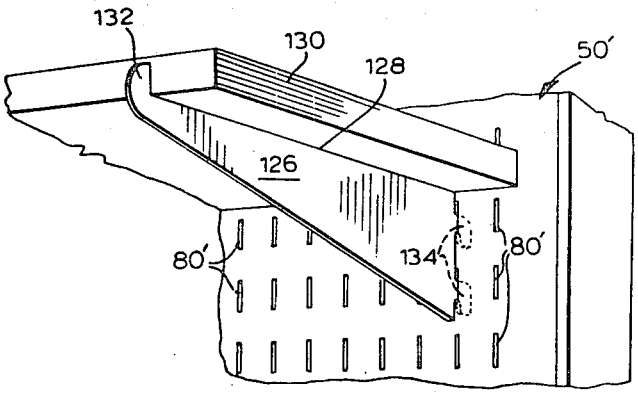
FIG. 9 is a view similar to FIG. 8 showing part of an alternative form of a wall unit and an associated article supporting element.

FIG. 9 shows part of an alternative form of wall unit and an associated shelf support. Thus, in FIG. 9, the wall unit is shown as including a panel 50' having openings 80' in the form of narrow elongate slots disposed with their major axes in the vertical direction of the panel. The shelf support is generally indicated at 126 and is in the form of a flat plate of generally triangular shape formed in its top portion with a recess 128 to receive the shelf 130. An upwardly directed tab 132 at the outer end of the support restrains the shelf against outward movement. Two tabs 134 are formed integrally at the inner edge of the support and are angled downwardly to engage through vertically adjacent ones of the openings 80' and behind the inner surface of the front wall of panel 50'.

Figure 10:
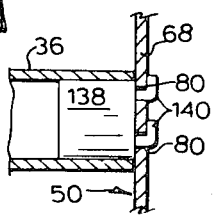
FIG. 10 is a vertical sectional view showing a detail of FIG. 2.

FIG. 10 is a detail view which shows the manner in which a hanger rod is coupled to one of the wall units. For convenience, reference will be made to the rod 36 (FIG. 2). One end part of the rod is visible in FIG. 10 and it will be seen that the rod is hollow. A fitment 136 is disposed at the end of rod 36 and includes a cylindrical portion 138 which fits closely inside rod 136 and two projecting tabs 140 which are of generally right angular shape so as to be capable of being hooked through two vertically adjacent openings 80 in panel 50 of the relevant wall unit. A similar fitment (not shown) is provided in the other end of rod 36. If necessary, rod 36 may be of telescopic form to facilitate fitting of the rod between the two wall units.

Figure 11:
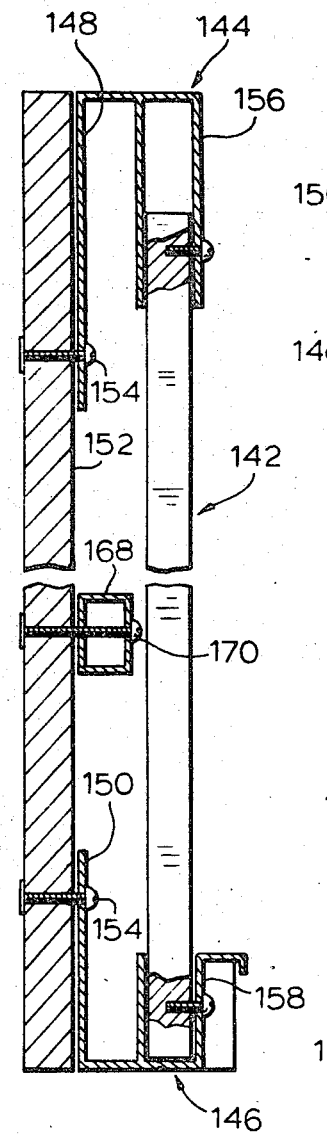
FIG. 11 is a side view of a display structure according to a further feature of the invention.
Figure 12:
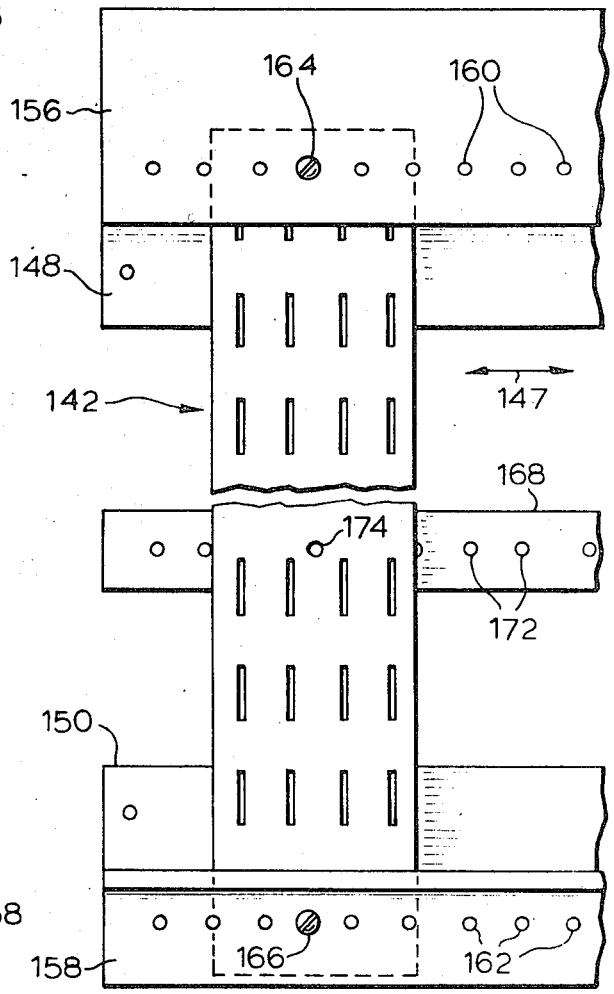
FIG. 12 is a front view corresponding to FIG. 11.

FIGS. 11 and 12 illustrate a display structure according to a further embodiment of the invention. The structure includes a wall unit 142 which is generally similar to the wall units shown in the previous views although somewhat narrower in width. Unit 142 is mounted in upper and lower tracks 144 and 146 respectively so that the position of the unit can be adjusted transversely along the tracks as indicated by arrow 147 in FIG. 12. After adjustment, the unit can be secured in an adjusted position as will be described. It will be appreciated that this arrangement will allow for great versatility in the positioning of elements suspended from the wall unit.

Although a single adjustably mounted wall unit may be employed, it is believed that, in most situations, two or more such wall units will be provided side by side in the same tracks. They can then be adjusted with respect to one another so that trays, shelves or other supports of different width can be attached to the units. For example, if two wall units are provided, the spacing between them may be adjusted so that, say, four foot long shelves can be supported from the units. Then, when the store display is to be changed, the units may be moved closer together for supporting, say, two foot long shelves. Suitable backgrounds, displays, and the like can be provided behind the wall units if desired.

In this particular embodiment, wall unit 142 is formed by two channel shaped elements secured together face to face and is generally similar to one of the members 52 which make up the wall unit of FIG. 3. The outer (front) face of unit 142 is formed with an array of rectangular openings arranged in four vertical rows with the openings in each row in horizontal alignment with the openings in adjacent rows. Similar openings are provided in the inner (rear) faces of the unit but are not used in this case; the inner face of the unit could alternatively be unapertured.

FIG. 11 shows the cross-sectional shapes of the two tracks 144 and 146. It will be seen that each track in essence defines parallel inner and outer channels and that the wall unit 142 is received in the outer channel of each track. The upper and lower tracks have respective inner limbs 148 and 150 of extended height, by which the tracks are secured to a supporting wall 152. In this embodiment, a cavity is present behind wall 152 and toggle bolts such as those indicated at 154 are used for securing the tracks to the wall. In other cases, screws, bolts or other fastening means can alternatively be employed. The tracks could be attached to respective ceiling and floor surfaces in appropriate cases.

The tracks also have outer limbs denoted 156 and 158 respectively. As can best be seen in FIG. 12, each of these limbs is formed with a series of spaced openings, denoted respectively 160 and 162 and the wall unit is provided behind each row of openings with a single screw threaded opening which is centralized transversely of the wall unit and into which a machine screw can be screwed for securing the wall unit to the relevant channel. Two such machine screws are indicated at 164 and 166 in FIG. 12. It will be appreciated that, in order to adjust the position of the wall unit, it is simply necessary to remove the screws 164 and 166, reposition the wall unit in the tracks, and replace the screws through appropriate ones of the openings 160 and 162. The openings in each row are spaced from one another on one inch centres so as to provide for versatility of positioning of the wall unit.

In order to provide additional support for the wall unit, particularly in heavy duty applications, an additional support member 168 extends parallel to the tracks 144 and 146 behind the wall unit and is secured to the supporting wall 152 by toggle bolts, one of which is indicated at 170 (FIG. 11). Support member 168 is of box shape in cross-section and is formed in its outer surface with a row of equally spaced openings 172, each of which is internally screw threaded. Wall unit 142 is provided with a single central opening 174 which can aligned with selected ones of the openings 172 and through which a machine screw can be inserted into one of the openings 172 to provide additional support if required.

The inner channels of the respective tracks 144 and 146 can be used for receiving other wall panels, decorative background material, mirrors, etc. In other applications in which no intermediate support member (as member 168) is required, single channel tracks may be employed.

Figure 13:
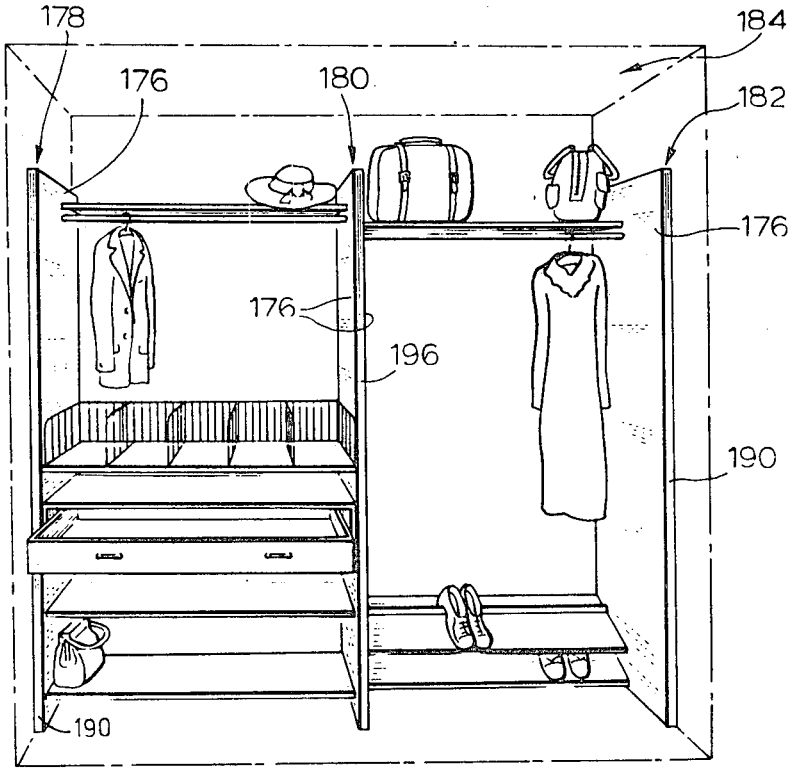
FIG. 13 is a front perspective view of a closet structure according to a further embodiment of the invention; and, FIG. 14 is a plan view of part of FIG. 13.
Figure 14:
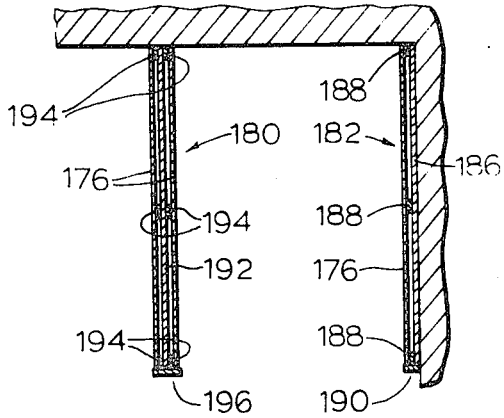

FIGS. 13 and 14 show a closet constructed according to a further embodiment of the invention. The closet includes a number of relatively rigid, self-supporting panels each having an outer surface formed with an array of openings generally similar to the openings described in connection with the preceding embodiments. However, in this case, each panel is in the form of a single metal sheet through which the openings are formed. The panels are individually denoted by reference numeral 176 in FIGS. 13 and 14. For convenience of illustration, the openings in the panels have not been shown in detail, but may be assumed to be shaped and arranged similarly to the openings 80 shown in FIG. 5.

The panels 176 form part of three wall units indicated at 178, 180 and 182. The closet is built into an alcove 184, for example in a room in a house and the two wall units 178 and 182 are positioned on opposite side walls of the alcove, while the third unit 180 is located midway between the other two wall units and generally parallel thereto.

In FIG. 14, units 180 and 182 are shown in plan and unit 182 will now be described as representative of both it and unit 178. Unit 182 includes a backing sheet 186, for example, of plywood, which is attached to the relevant wall surface of alcove 184. The perforated metal panel 176 of unit 182 is then mounted on the plywood backing sheet with the interposition of wooden strapping members 188. In this embodiment, three such members are provided in vertical positions spaced equally across backing sheet 186 although there is no limitation in this regard. Panel 176 is then screwed directly to the strapping and is maintained by the strapping at a spacing from the backing sheet 186. This spacing is provided to accommodate article supporting elements engaged in the openings in panel 176. Finally, a trim strip or pilaster of wood 190 is provided at the outer vertical edge of wall unit 182.

Wall unit 180 is of similar construction except that includes two perforated metal sheets 176 disposed in spaced parallel positions on opposite sides of a wooden backing sheet 192. Both of the panels 176 are spaced from the backing sheet by strapping 194. Again, a pilaster 196 is provided along the outer vertical edge of wall unit 180.

Article supporting elements of many different forms can be used with the closet and a number of illustrative examples are shown in FIG. 13. Clothes hanging rods and the like can be supported generally in the manner illustrated in FIG. 10, while shelves, drawer units and racks can be supported, for example, by elements of the form shown in FIG. 7. In any event, it will be appreciated that the closet allows a wide variety of storage configurations which can be rapidly and easily changed at will. Also, it should be noted that the term "closet" as used herein is intended to be broadly interpreted and is not to be limited to domestic clothes closets.

It will be appreciated from the preceding description that the invention provides extremely versatile display and/or storage structure. Thus, the shelf supports or other articles supporting elements can be easily and quickly fitted to a wall unit in any appropriate position. Similarly, an existing arrangement of article supporting elements on a wall unit can be easily varied. Completely new visual display arrangements can be easily and quickly created.

While the specific display structures shown in the drawings are believed to be eminently suitable for use in store displays, it is to be understood that there is no limitation to these particular arrangements. In its simplest form, a single wall unit could be used by itself as a display structure. The unit could be mounted at right angles to a wall, flat against a wall (in which case only one side of the unit could be used) or even in a free standing arrangement if the unit is provided with a suitable base. On the other hand, a display structure could be made considerably more complex than the structures shown in the drawings by adding additional wall units, shelves, etc.

By way of example, it may be convenient to note the following typical dimensions of a wall unit of the form shown in FIGS. 1 to 5. Thus, the unit may be of an overall width of 24" (each member 52 accordingly being of 4" in width), of a thickness of 1", and of a height of 84" including the spigots 52*a*. The spigots may be of 4" in height. The openings 80 in the panel 50 of the unit may each be of approximately $\frac{1}{8}'' \times \frac{1}{4}''$ and spaced from one another on 1" centres transversely of the panel and on $\frac{1}{2}''$ centres vertically of the panel. The channel-shaped elements from which the members 52 are made may be 18 gage steel channel of dimensions $\frac{1}{2}'' \times 4''$.

The spacings between the openings 80 in the panel 50 provide for almost infinitely adjustable positioning of article supporting elements on the panel. Thus, any one supporting element can be adjusted transversely in increments of 1" and vertically in increments of $\frac{1}{2}''$.

It should of course be noted that the dimensions referred to above are given merely by way of example for the purpose of illustration. In other applications, the quoted dimensions could vary considerably.

It will be appreciated that the wall units and display structures referred to herein may find application not only in the display of merchandise for sale, but in any applications in which articles are required to be displayed and/or stored. Residential applications of the invention are also envisaged. For example, structures generally similar to that shown in FIGS. 1 and 2 could be used as closets or other storage structures in residential homes. The front of the structure could, if appropriate, be closed by a curtain suspended from a hanger rod extending across the front of the structure.

Variations in the wall unit are of course possible within the broad scope of the invention. Thus, while the units shown in the drawings have openings on both sides, this is not essential. In the case of a unit intended to be attached directly to a wall of a building, for example, openings need be provided on one side only. This could be accomplished, for example, by constructing the wall unit from a series of individual channel section elements welded together side by side. However, it should also be noted that the wall unit need not be constructed in the manner described whether openings are provided on one side only or on both sides. In another embodiment, the wall unit could be constructed from a sheet of steel pre-punched with an array of openings and attached to a suitable supporting framework.

It should also be noted that the specific forms of article supporting elements disclosed in the drawings are not exhaustive. In a simple case, a wire hook could, for example, be used to suspend an article directly from a wall unit.

It will be realized that variations are possible in the shape and arrangement of the openings in the panel of the wall unit according to the invention. The drawings show two examples but are not considered to be exhaustive. In the embodiments of FIGS. 1 to 8 and 10, the openings are rectangular in shape and are arranged with their major axes horizontal. In FIG. 9, on the other hand, the openings are also rectangular but are arranged with their major axes vertical. The embodiment shown in FIG. 9 is believed to be particularly suitable for heavy duty applications; that is, for use in situations in which the wall unit is required to support relatively heavy loads. An example of such an application would be where the unit is to be used to support shelves for carrying paint cans in paint store. However, it is to be realized that the range of application of the embodiment shown in FIG. 9 is at least as wide as the range of application of the other embodiments. Variations in the shape and size of the openings are of course possible. For example, the openings could be of circular shape.

In the closet structure of FIGS. 13 and 14, the centre wall unit 180 could be omitted and/or one or more additional wall units could be provided on the back wall of the alcove.

I claim:

1. A closet structure installed in a building having an alcove defined by first and second side walls and a back wall of said building, said walls being disposed generally vertically with said side walls in generally parallel positions, and said back wall extending between said side walls generally normal thereto, wherein the improvement comprises a wall unit disposed on each of said first and second side walls, said back wall remaining exposed between the wall units, and each wall unit comprising: a relatively rigid, self-supporting panel having an inner surface and a generally flat outer surface said panel being formed with an array of openings which cover substantially the whole of said outer surface, said openings being arranged in a plurality of vertical rows spaced equally across the surface with the openings in each row equally spaced from one another and in horizontal alignment with corresponding openings in adjacent rows, said openings extending through said panel to the inner surface thereof; and means coupling each said panel to the relevant one of said side walls with the outer surface of the panel generally vertical and the inner surface spaced from the wall; and wherein a plurality of article supporting elements are engaged in said openings and are adapted to support articles of clothing and the like.

2. A structure as claimed in claim 1, further comprising an additional wall unit disposed between and generally parallel to the wall units on said first and second side walls and secured to said back wall, said additional wall units comprising two of said self-supporting panels and means supporting said panels in spaced parallel positions.

* * * * *